US012130111B2

(12) United States Patent
Riley

(10) Patent No.: US 12,130,111 B2
(45) Date of Patent: Oct. 29, 2024

(54) AIR GUN, REMOVABLE MAGAZINE THEREFOR AND ASSOCIATED METHODS

(71) Applicant: Sabre Security Equipment Corporation, Fenton, MO (US)

(72) Inventor: Louis F. Riley, Conway, AR (US)

( * ) Notice: Subject to any disclaimer, the term of this patent is extended or adjusted under 35 U.S.C. 154(b) by 83 days.

(21) Appl. No.: 18/060,893

(22) Filed: Dec. 1, 2022

(65) Prior Publication Data

US 2024/0183634 A1 Jun. 6, 2024

(51) Int. Cl.

| | |
|---|---|
| ***F41A 17/00*** | (2006.01) |
| ***F41A 17/46*** | (2006.01) |
| ***F41B 11/56*** | (2013.01) |

(52) U.S. Cl.

CPC ..... *F41B 11/56* (2013.01); *F41A 17/46* (2013.01)

(58) Field of Classification Search

CPC ..... F41A 17/46; F41A 17/20; F41A 17/24; F41A 17/26; F41A 17/28; F41A 17/30; F41A 17/56; F41B 11/56

See application file for complete search history.

(56) References Cited

U.S. PATENT DOCUMENTS

| | | | | |
|---|---|---|---|---|
| 3,236,222 | A | 2/1966 | Pitcher | |
| 3,921,614 | A | 11/1975 | Fogelgren | |
| 4,531,503 | A | 7/1985 | Shepherd | |
| 5,906,191 | A * | 5/1999 | Wonisch | F41A 17/22 124/31 |
| 7,353,815 | B2 | 4/2008 | Wei | |
| 7,398,776 | B2 | 7/2008 | Casas Salva | |
| D611,115 | S | 3/2010 | Pennington | |
| 7,757,682 | B2 | 7/2010 | Kaminker et al. | |
| 7,784,454 | B2 | 8/2010 | Tiberius et al. | |
| 7,921,838 | B2 | 4/2011 | Tippmann, Jr. et al. | |
| 8,011,355 | B2 | 9/2011 | Kawashima | |
| 8,203,821 | B2 | 6/2012 | Isieh et al. | |
| 8,430,086 | B2 | 4/2013 | Tippmann, Jr. et al. | |
| 8,479,432 | B2 | 7/2013 | Braun | |
| 8,485,858 | B2 | 7/2013 | Wei | |
| 8,550,062 | B2 | 10/2013 | Maeda | |
| 8,602,784 | B2 | 12/2013 | Dvorak | |
| 8,726,895 | B2 | 5/2014 | Tippmann, Jr. et al. | |

(Continued)

FOREIGN PATENT DOCUMENTS

| | | | | |
|---|---|---|---|---|
| JP | H10-220993 | * | 8/1998 | F41B 11/56 |
| KR | 20190093362 | * | 8/2019 | F41A 17/30 |

*Primary Examiner* — John E Simms, Jr.

(74) *Attorney, Agent, or Firm* — Hartman Global IP Law; Gary M. Hartman; Domenica N.S. Hartman

(57) ABSTRACT

An air gun, a removable magazine for an air gun, and associated methods. The air gun includes a safety mechanism that in a safety-on position prevents the trigger from actuating the firing mechanism and closes the gas supply duct, and in a safety-off position enables the trigger to actuate the firing mechanism and opens the gas supply duct to enable actuating the firing mechanism with compressed gas to fire a projectile. The removable magazine includes, a projectile feeder, a cavity for a gas canister, a push valve for selectively releasing pressurized gas from the gas canister, and a valve actuator. The valve actuator includes a socket that releasably receives a nipple of a gas supply coupling carried by an air gun, forms a seal with the nipple, and opens the aerosol valve when coupled with the gas supply coupling.

19 Claims, 7 Drawing Sheets

(56) References Cited

U.S. PATENT DOCUMENTS

| | | | | |
|---|---|---|---|---|
| 9,194,647 | B2 * | 11/2015 | Maeda | F41A 17/38 |
| 9,200,865 | B2 | 12/2015 | Maeda | |
| 9,291,420 | B1 * | 3/2016 | Jensen | F41A 19/01 |
| 9,395,146 | B2 | 7/2016 | Tippman, Jr. et al. | |
| 11,209,237 | B2 | 12/2021 | Quek | |
| 2003/0106545 | A1 * | 6/2003 | Verini | F41B 11/62 124/74 |
| 2006/0191525 | A1 | 8/2006 | Dai | |
| 2007/0151551 | A1 | 7/2007 | Verini | |
| 2010/0126486 | A1 * | 5/2010 | Halmone | F41B 11/721 124/31 |
| 2013/0055996 | A1 | 3/2013 | Perry | |
| 2013/0220294 | A1 | 8/2013 | Tippmann, Jr. et al. | |
| 2021/0055082 | A1 | 2/2021 | Geisler et al. | |
| 2021/0108879 | A1 | 4/2021 | Clemons et al. | |
| 2021/0381797 | A1 * | 12/2021 | Buys | F41B 11/62 |

* cited by examiner

AIR GUN, REMOVABLE MAGAZINE THEREFOR AND ASSOCIATED METHODS

BACKGROUND OF THE INVENTION

The invention generally relates to air guns, their components, and their methods of use.

The term "air gun" is commonly used to refer to a gun that shoots a projectile by releasing an amount of compressed air, carbon dioxide ($CO_2$), or other gas (hereinafter sometimes simply referred to as gas as a matter of convenience) to propel the projectile upon actuating a trigger assembly, such as by pulling a finger trigger. In some air guns, the compressed gas is supplied from a canister that contains the compressed gas until a charge of a preselected quantity of the gas is released from the canister by means of the trigger assembly, and the air is conducted to a firing assembly to forcefully propel the projectile from the gun through a barrel. As with any gun, an unintended discharge of the gun, for example, because of accidentally activating the trigger mechanism by encountering an object or accidental activation when handling, is undesirable. Therefore, guns typically have one or more safety mechanisms that prevent an unintended discharge.

Some air guns, typically in the general form of semi-automatic air pistols, have a removable ammunition magazine that holds both a compressed gas canister and a number of projectiles. The magazine is typically removably received within a pistol grip carried by the frame of the gun. A challenge with such designs, however, is to allow reloading of projectiles into the magazine without releasing unused compressed air from the gas canister during such reloading. Therefore, it would also be desirable to have a removable magazine in which the projectiles can be reloaded without losing unspent pressurized gas from gas canister.

BRIEF SUMMARY OF THE INVENTION

The intent of this section of the specification is to briefly indicate the nature and substance of the invention, as opposed to an exhaustive statement of all subject matter and aspects of the invention. Therefore, while this section identifies subject matter recited in the claims, additional subject matter and aspects relating to the invention are set forth in other sections of the specification, particularly the detailed description, as well as any drawings.

The present invention provides, but is not limited to, air guns, their components, and their methods of use.

According to a nonlimiting aspect of the invention, an air gun is provided. The air gun includes a firing mechanism for firing a projectile from the air gun by means of compressed gas, a gas supply duct configured to direct a supply of compressed gas to the firing mechanism, a trigger configured to actuate the firing mechanism when the trigger is shifted from a non-firing position to a firing position, and a safety mechanism having a safety-on position and a safety-off position. The safety mechanism in the safety-on position prevents the trigger from actuating the firing mechanism and closes the gas supply duct. The safety mechanism in the safety-off position enables the trigger to actuate the firing mechanism and opens the gas supply duct to enable actuating the firing mechanism with compressed gas to fire a projectile.

According to another nonlimiting aspect of the invention, a removable magazine for an air gun is provided. The removable magazine includes a magazine body, a projectile feeder carried in the magazine body, a cavity defined inside the magazine body for receiving a gas canister therein, a push valve carried by the magazine body for selectively releasing pressurized gas from a gas canister disposed in the cavity, and a valve actuator carried by the push valve. The valve actuator includes a socket configured to releasably receive therein a nipple of a gas supply coupling carried by an air gun and form a seal with the nipple and to open the push valve when operatively coupled with the gas supply coupling.

According to yet another nonlimiting aspect of the invention, a method of using the air gun is provided. The method includes switching the safety mechanism to the safety-off position by simultaneously enabling the trigger to actuate the firing mechanism and opening the gas supply duct. The method may further include switching the safety mechanism to the safety-on position by simultaneously preventing the trigger from actuating the firing mechanism and closing the gas supply duct.

In some arrangements, the air gun of the present disclosure may provide an improved safety mechanism to prevent unintended discharge, and/or provide a simpler and/or more efficient mechanism for loading and/or reloading projectiles in a removable magazine without losing unspent pressurized gas in a gas canister carried by the removable magazine.

These and other aspects, arrangements, features, and/or technical effects will become apparent upon detailed inspection of the figures and the following description.

DETAILED DESCRIPTION OF THE INVENTION

Figure 1:
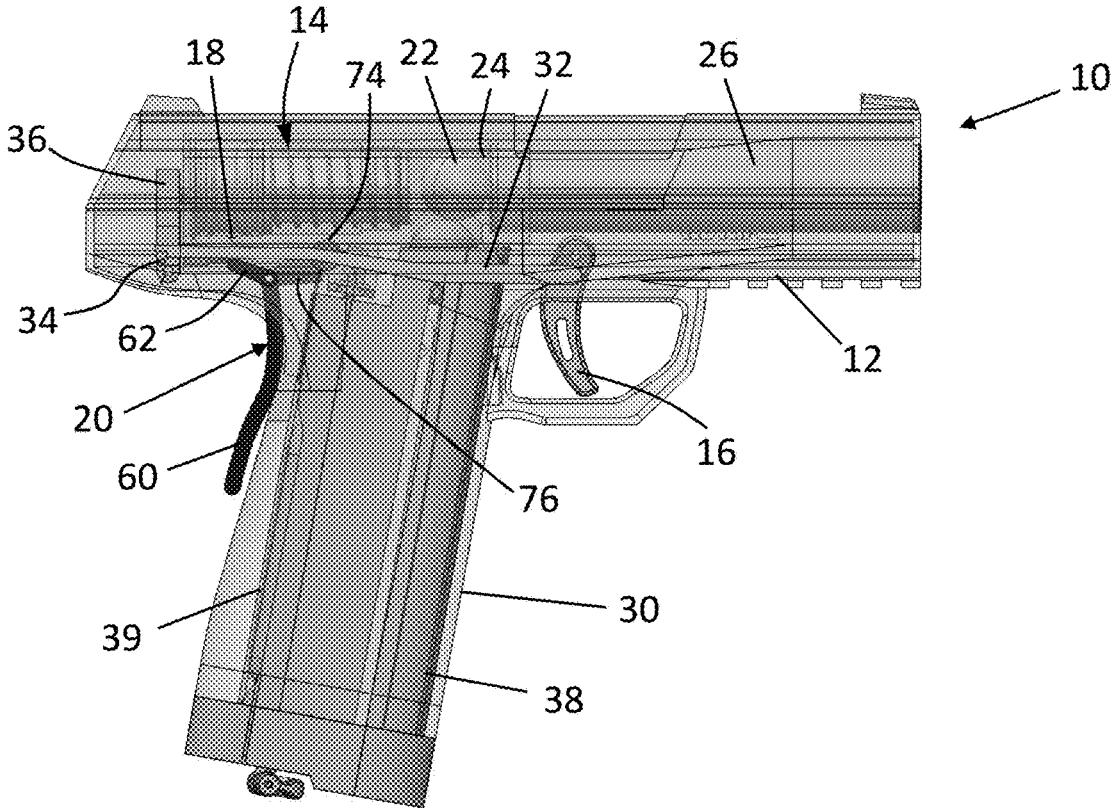
FIG. 1 is a right side view of an air gun according to nonlimiting aspects of the invention and shows internal features of the air gun related to a safety mechanism and a removable ammunition magazine that contains projectiles arranged to be fired from the air gun.
Figure 2:
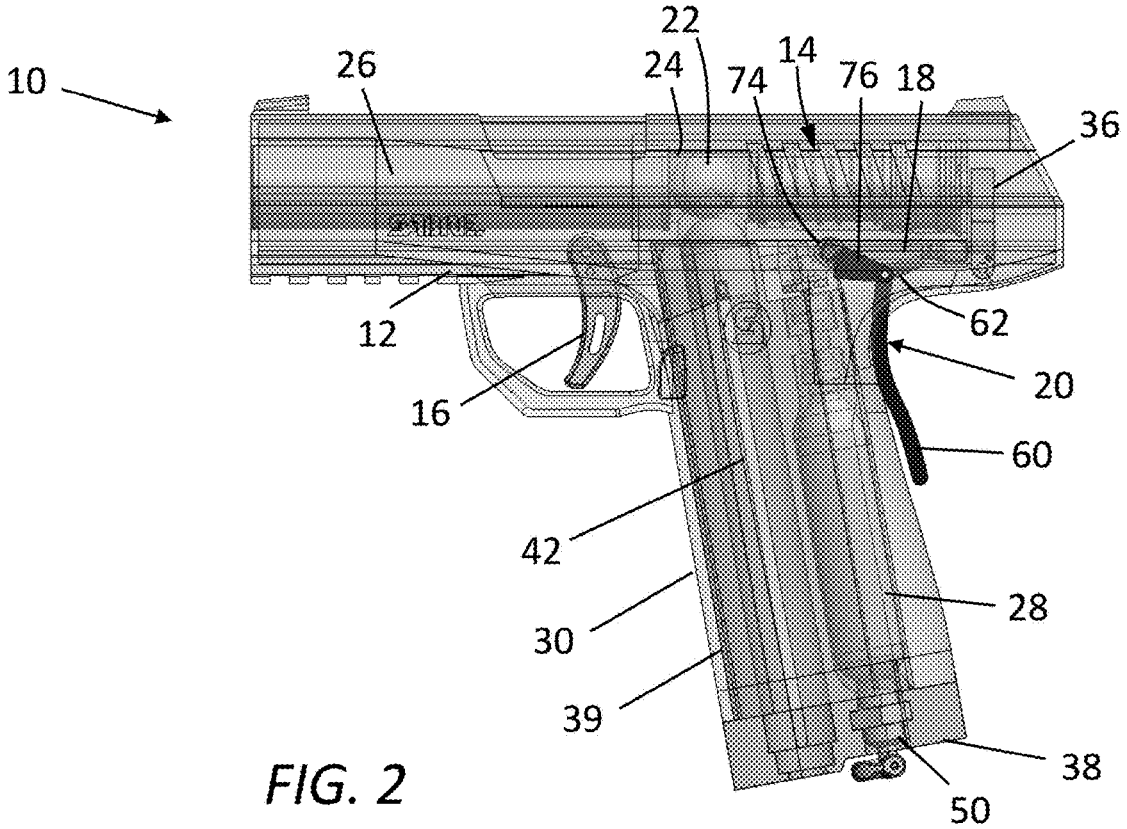
FIG. 2 is a left side view of the air gun of FIG. 1 showing internal features related to the safety mechanism and the removable ammunition magazine and additionally showing a gas canister of the removable ammunition magazine.
Figure 3:
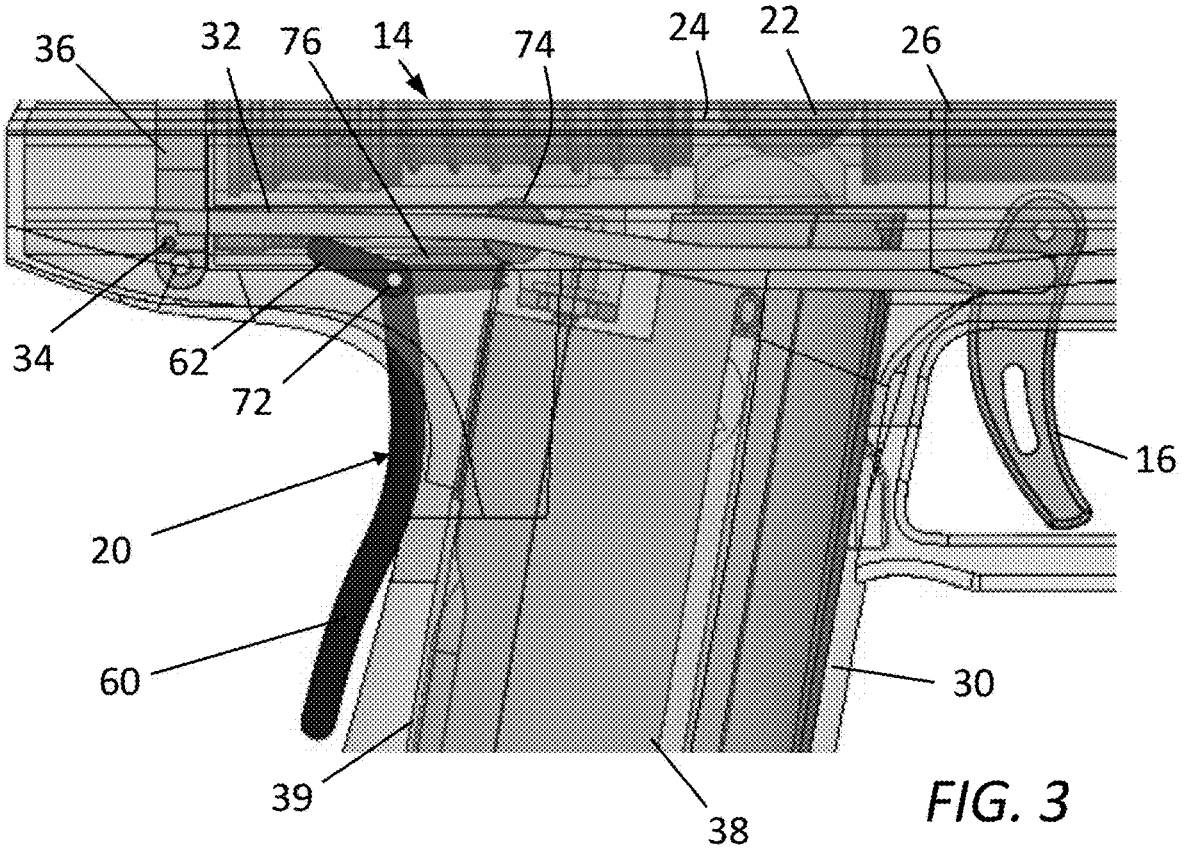
FIG. 3 is an enlarged right side view of the air gun of FIGS. 1 and 2 showing details of the safety mechanism in a safety-on position whereby operation of a trigger of the air gun is disabled.
Figure 4:
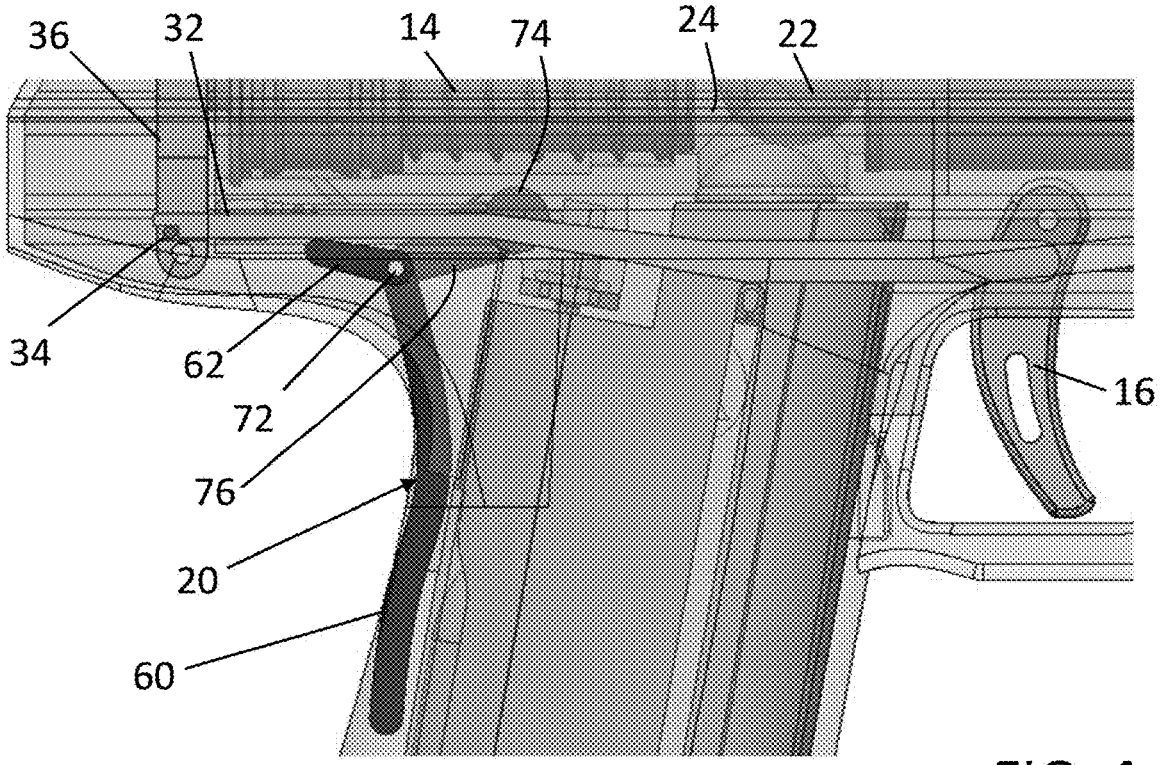
FIG. 4 is an enlarged right side view of the air gun of FIGS. 1 and 2 showing details of the safety mechanism in a safety-off position whereby operation of the trigger of the air gun is enabled.

The intended purpose of the following detailed description of the invention and the phraseology and terminology employed therein is to describe what is shown in the drawings, which depict one or more nonlimiting embodiments of the invention, and to describe certain but not all aspects of the embodiment(s) to which the drawings relate. The following detailed description also identifies certain but not all alternatives of the embodiment(s) depicted in the drawings. As nonlimiting examples, the invention encompasses additional or alternative embodiments in which one or more features or aspects shown and/or described as part of a particular embodiment could be eliminated, and also encompasses additional or alternative embodiments that combine two or more features or aspects shown and/or described as part of different embodiments. Therefore, the appended claims, and not the detailed description, are intended to particularly point out subject matter regarded to be aspects of the invention, including certain but not necessarily all of the aspects and alternatives described in the detailed description.

Although the invention will be described hereinafter in reference to air guns in the form of a hand pistol shown in the drawings, it will be appreciated that the teachings of the invention are more generally applicable to a variety of types of air guns that operate to use a supply of compressed gas, such as air, $CO_2$, or other (non-ignited) gases, to forcefully eject a projectile, such as, but not limited to, long guns, other styles of hand guns, and nail guns.

To facilitate the description provided below of the embodiment(s) represented in the drawings, relative terms, including but not limited to, "proximal," "distal," "anterior," "posterior," "vertical," "horizontal," "lateral," "front," "rear," "side," "forward," "rearward," "top," "bottom," "upper," "lower," "above," "below," "right," "left," etc., may be used in reference to the orientation of the air gun and its components during its use and/or as represented in the drawings. All such relative terms are useful to describe the illustrated embodiment(s) but should not be otherwise interpreted as limiting the scope of the invention.

Turning now to the drawings, an air gun 10 is represented in FIGS. 1 through 12 as including a frame 12 that carries a firing mechanism 14, a trigger 16, a gas supply duct 18, and a safety mechanism 20. The firing mechanism 14 is configured to fire a projectile 22 disposed in a firing chamber 24 through and out of a barrel 26 by means of a charge of compressed gas supplied from a gas canister 28 to the firing mechanism 14 via the gas supply duct 18 when the trigger 16 is moved from a non-firing position to a firing position, for example, by a user's finger squeezing the trigger 16. The projectile 22 may be any suitable projectile, such as a pepperball, paintball, BB, or other generally similar projectile. The air gun 10 represented in the drawings is in the form of a semi-automatic hand pistol, though the air gun 10 could in other arrangements have the form of a carbine or other long gun. A grip 30, such as a pistol grip, extends downwardly from the frame 12 immediately behind the trigger 16. The grip 30 is sized and spaced apart from the trigger 16 so as to be easily held in the palm of a user's hand with a finger of the hand wrapped around the front of the trigger 16. The trigger 16 shifts relative to the frame 12 to shift a trigger bar 32 axially (that is, generally along the axial direction of the barrel 26) backward and forward relative to the frame 12. When the trigger 16 is pulled toward the grip 30, it shifts the trigger bar 32 rearwardly to engage and push against a stop member 34 on a hammer 36, which then actuates the firing mechanism 14 that forcefully ejects the projectile 22 from the barrel 26.

Figure 13:
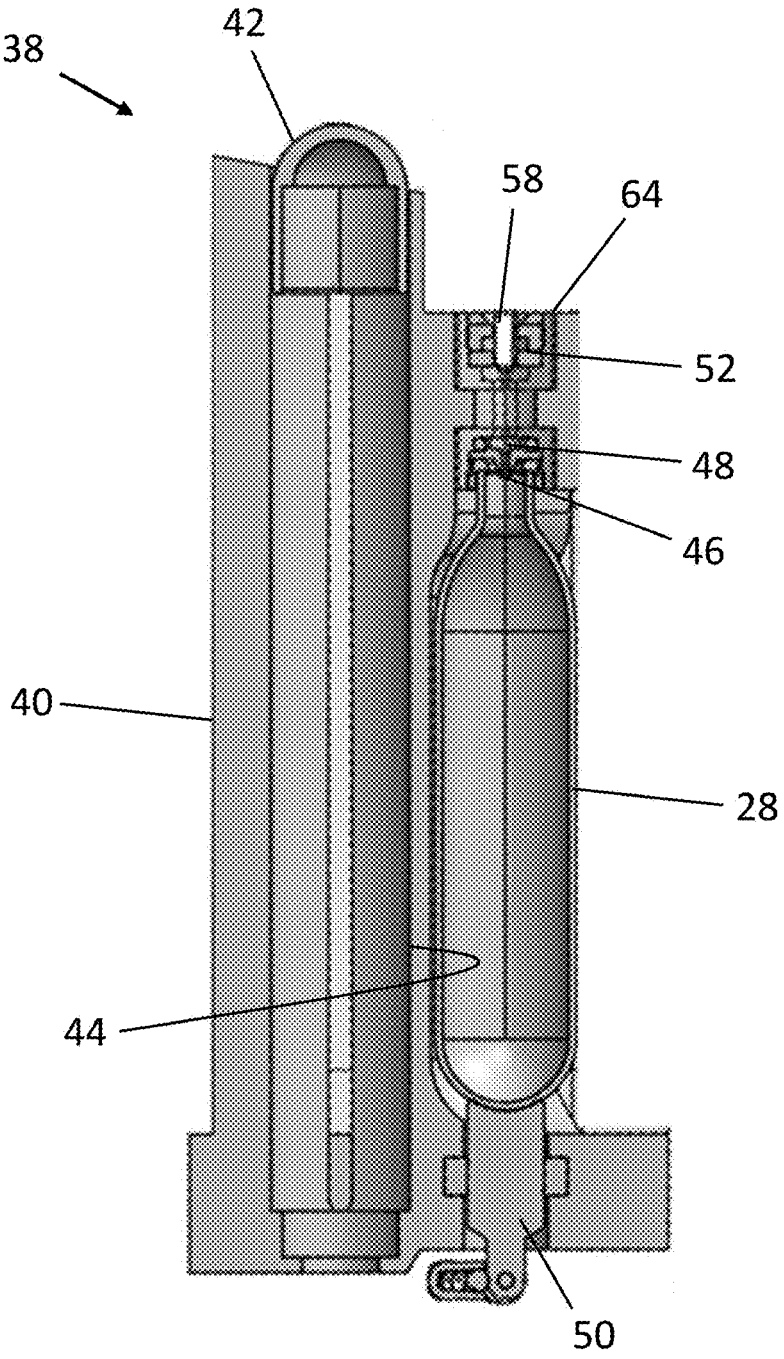
FIG. 13 is a diagrammatic left side view of the removable ammunition magazine.

A removable ammunition magazine 38 that carries the gas canister 28 and a supply of the projectiles 22 is configured to be releasably locked into a cavity inside the grip 30 that forms a magazine receiver 39, for example, by sliding into a bottom end of the grip 30, so as to provide the supply of projectiles 22 into the firing chamber 24 and provide a source of pressurized gas for actuating the firing mechanism 14. The magazine 38 may be locked into the magazine receiver 39 by any suitable releasable locking mechanism such that the magazine 38 may be removed from the magazine receiver 39 when the locking mechanism that releasably locks the magazine 38 inside the grip 30 is released. As best seen in FIG. 13, the magazine 38 includes a magazine body 40 sized and shaped to slide in and out of the magazine receiver 39 in the grip 30. A projectile feeder 42 is carried inside the magazine body 40 and configured to hold a supply of projectiles 22 and successively feed the projectiles 22 into the firing chamber 24 when the magazine 38 is locked into place in the magazine receiver 39. For example, the projectile feeder 42 may include an elongate tube that receives the projectiles 22 and a spring mechanism in the tube configured to urge the projectiles 22 toward a top opening that opens into the firing chamber 24. Other arrangements for the projectile feeder 42 are also possible. A cavity 44 is defined inside the magazine body 40 and sized and shaped to receive the gas canister 28 therein. In this example, the magazine body 40 includes an opening along a rear edge thereof through which the gas canister 28 can be inserted into the cavity 44. A puncture needle 46 is disposed at a top end of the cavity 44 and is coupled to a push valve 48 that is carried by the magazine body 40. The push valve 48 may be, for example, a common aerosol valve having a valve member and a stem that opens the valve member when the stem is pushed toward the valve member, although other push-activated valves may be used. When the gas canister 28 is inserted into the cavity 44, a plunger mechanism 50 at the lower end of the cavity 44 can be actuated, for example, with threads and/or a cam mechanism, to press the gas canister 28 upwardly against the puncture needle 46, which punctures a top end of the gas canister 28, and thereby locks the gas canister 28 into an operative position inside the cavity 44. A valve actuator 52 is carried by the magazine body 40 and is operatively coupled to the push valve 48 such that when the valve actuator 52 is depressed, it opens the push valve 48 to allow pressurized gas inside the gas canister 28 to escape through the push valve 48 and the valve actuator 52. The valve actuator 52 is disposed at a top end of the magazine body 40, and is accessible from an exterior of the magazine body 40, for example, through an opening 64 at the top end of the magazine body 40.

Figure 9:
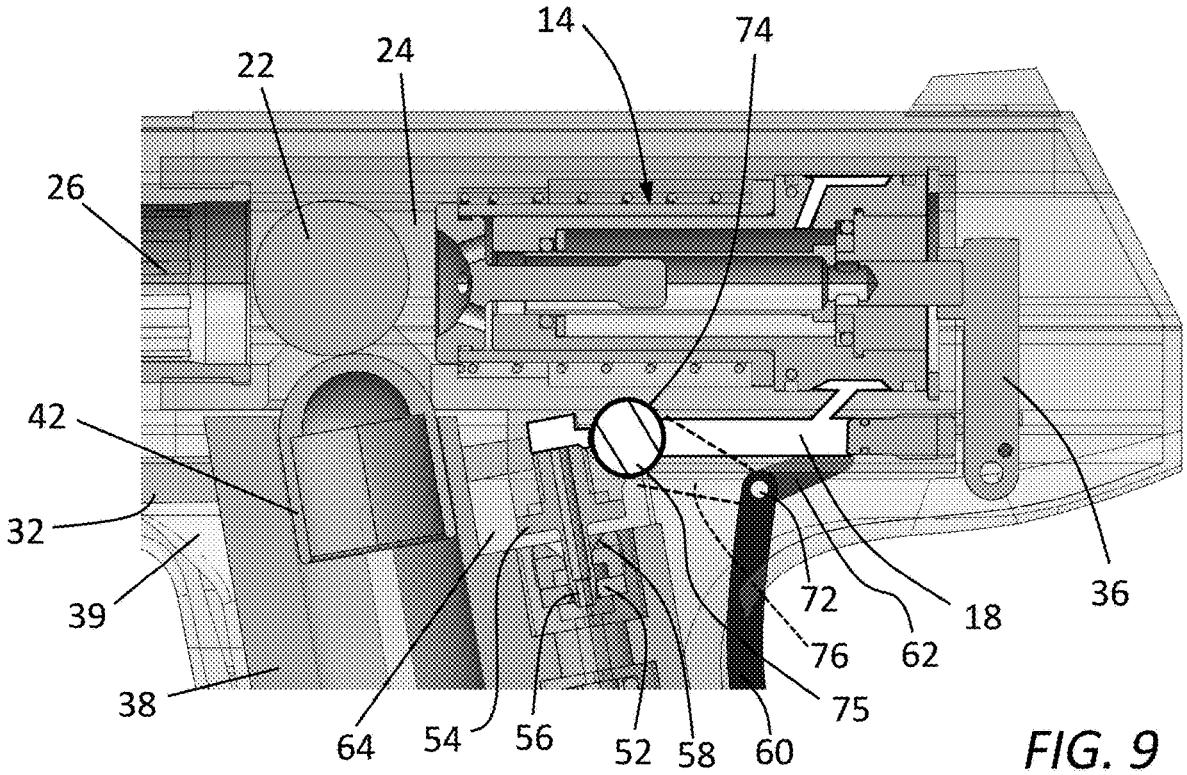
FIG. 9 is an enlarged left side diagrammatic view of the safety mechanism of FIGS. 1 and 2 in the safety-on position, and shows a passage of the valve of the safety mechanism in a closed position to prevent the compressed gas from flowing therethrough.
Figure 10:
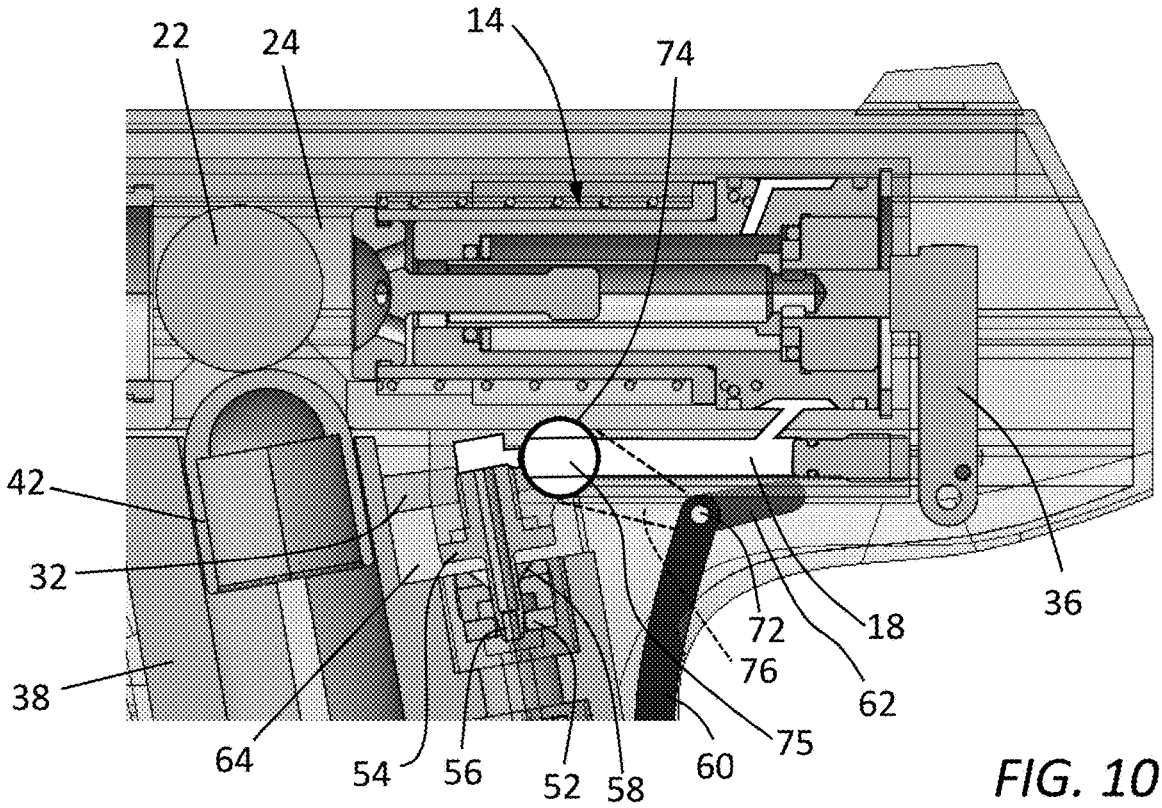
FIG. 10 is an enlarged left side diagrammatic view of the safety mechanism in the safety-off position, wherein the passage of the valve of the safety mechanism is shown in an open position to enable the compressed gas to flow therethrough.

As best seen in FIGS. 9 and 10, in order to operatively couple the gas canister 28 in fluid communication with the firing mechanism 14 to supply compressed gas from the gas canister 28 to the firing mechanism 14, a gas supply coupling 54 extends downwardly into the magazine receiver 39 from the top end of the cavity 44 to releasably and sealingly connect to the valve actuator 52 of the magazine 38, when the magazine 38 is inserted and locked into its operative position in the magazine receiver 39. The gas supply coupling 54 is carried by the frame 12 and is in fluid connection with the gas supply duct 18. The gas supply coupling 54 includes a nipple 56 that is releasably received within a socket 58 in the valve actuator 52. Preferably, the socket 58 forms a gastight seal around the nipple 56 when so inserted. When the magazine 38 is locked into place, the nipple 56 extends into the socket 58, and the gas supply coupling 54 pushes the valve actuator 52 downwardly, which in turn opens the push valve 48, thereby completing a fluid circuit connection between the gas canister 28 and the firing mechanism 14. Conversely, when the magazine 38 is removed from the grip 30, the valve actuator 52 simply pulls away from the gas supply coupling 54, thereby removing the nipple 56 from the socket 58 and allowing the push valve 48 to close so as to interrupt the fluid coupling between the gas canister 28 and the fine mechanism 14. Thus, the magazine 38 can be removed from the grip 30, for example to reload projectiles 22 into the projectile feeder 42, and any compressed gas in the gas canister 28 is retained therein because the push valve 48 closes when the magazine 38 is removed from the magazine receiver 39 in the grip 30. For example, the gas canister 28 is pierced when installed in the magazine 38, but does not expel any compressed gas therefrom until the push valve 48 is engaged. The magazine 38 carrying the pierced gas canister 28 can then be inserted and removed from the air gun 10 without the compressed gas escaping from the gas canister 28. This feature enables allows a user to reload the magazine 38 with projectiles 22 while simultaneously retaining the gas canister 28 and remaining compressed gas (for example, air or $CO_2$) because the compressed gas only flows when the magazine 38 is operatively inserted, and preferably locked, in the magazine receiver 39 in the grip 30 of the air gun 10.

The safety mechanism 20 is configured to prevent unintended discharge of a projectile 22 (e.g., accidental firing). The safety mechanism 20 has a safety-on position that prevents the trigger 16 from actuating the firing mechanism 14 and simultaneously closes the gas supply duct 18. The safety mechanism 20 also has a safety-off position that enables and/or allows the trigger 16 to actuate the firing mechanism 14 and simultaneously opens the gas supply duct 18 in order to enable and/or allow compressed gas from the gas canister 28 to flow to the firing mechanism 14 so as to fire the projectile 22. In order to accomplish this, the safety mechanism 20 includes two separate mechanisms, a first sub-mechanism that enables and disables the trigger 16 from operatively engaging the hammer 36, and a second sub-mechanism that enables and disables the supply of compressed gas to the firing mechanism 14. Because operation of the air gun 10 is such that it cannot fire if either there is no supply of compressed gas or the trigger 16 cannot operatively activate the hammer 36, the safety mechanism 20 provides at least one redundant safety mechanism for preventing an unintended discharge of a projectile 22. In addition, the safety mechanism 20 may help prevent or reduce loss of unused pressurized gas from the gas canister 28 by disabling unintended discharges of compressed gas to the firing mechanism 14.

Figure 5:
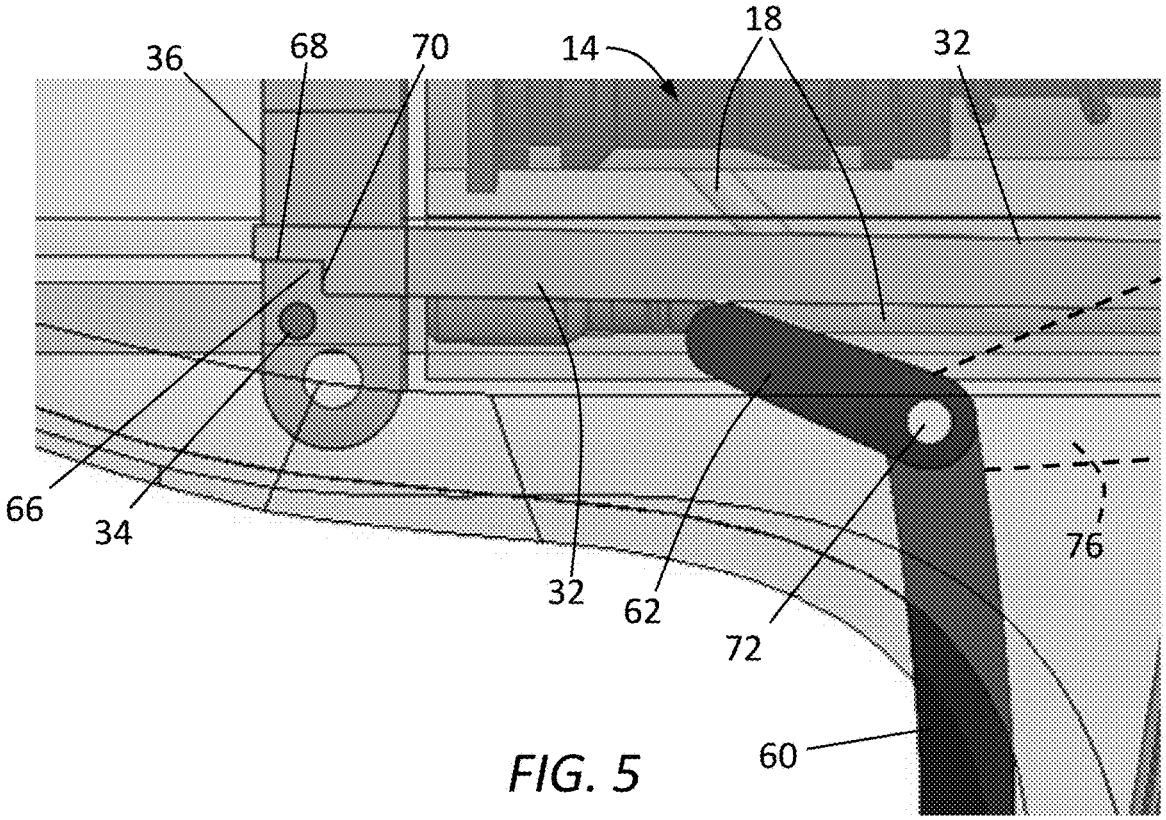
FIG. 5 is a further enlarged right side view of the safety mechanism of FIGS. 1 and 2 in the safety-on position.
Figure 6:
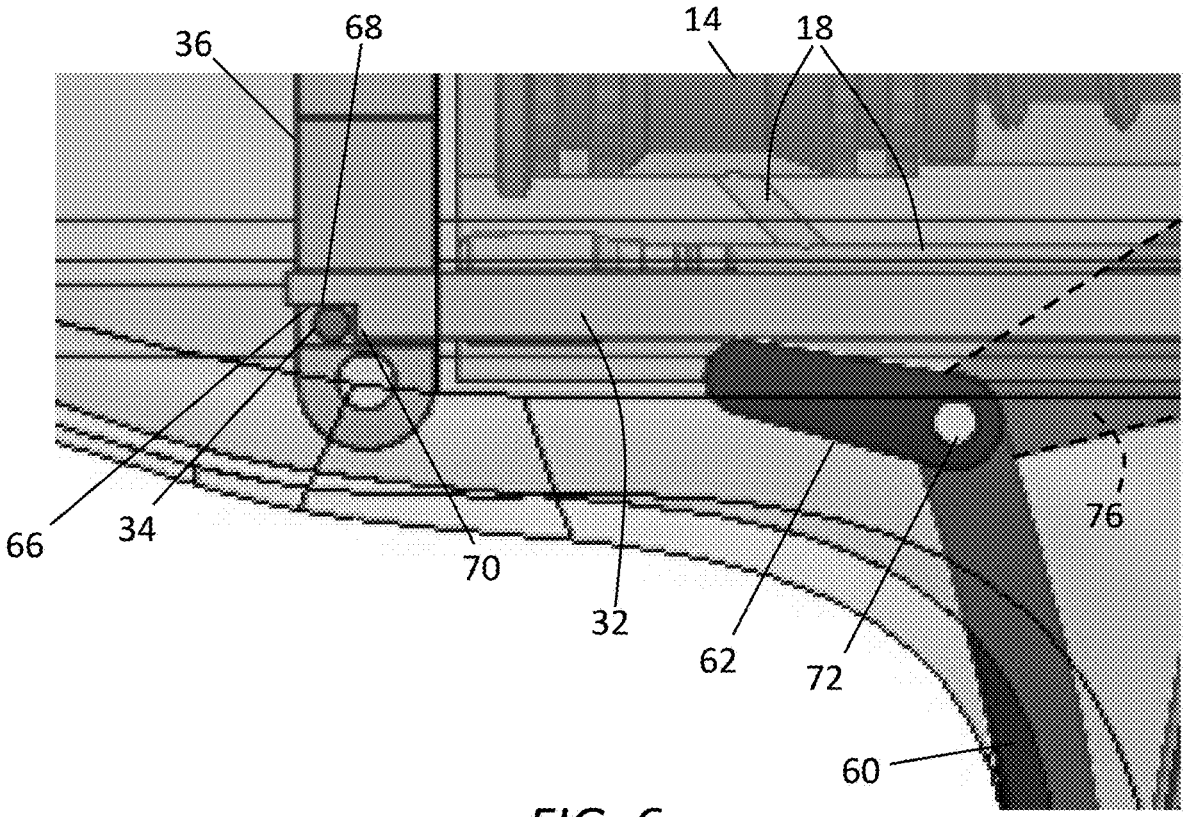
FIG. 6 is a further enlarged right side view of the safety mechanism of FIGS. 1 and 2 in the safety-off position.

As perhaps best seen in FIGS. 3-6, the first sub-mechanism of the safety mechanism 20 is a hammer safety mechanism that includes a movable safety actuator 60 that includes or is otherwise connected to a finger 62, such that movement of the safety actuator 60 toward the grip 30 causes the trigger bar 32 to move either to a safe position in which the trigger bar 32 is out of alignment with the stop member 34 of the hammer 36 or to a ready position in which the trigger bar 32 is aligned for engagement with the stop member 34. In this example, a forward end of the trigger bar 32 is pivotably connected to the trigger 16 such that when the finger 62 of the safety actuator 60 engages and shifts the rear end of the trigger bar 32 upwardly, the rear end of the trigger bar 32 is in the safe position and out of alignment with the stop member 34. With the trigger bar 32 thus in the safe position, although the trigger bar 32 is able to travel linearly toward the rear of the air gun 10 and the hammer 36 when the trigger 16 travels toward the rear of the air gun 10, the trigger bar 32 will not engage the stop member 34, and because of this misalignment with the hammer 36, cannot activate the hammer 36 and in turn cannot activate the firing mechanism 14. Conversely, when the finger 62 of the safety actuator 60 disengages from and/or shifts the rear end of the trigger bar 32 downwardly, the rear end of the trigger bar 32 is then in alignment with the stop member 34 in the ready position. With the trigger bar 32 thus in the ready position, when the trigger 16 shifts the trigger bar 32 linearly toward the rear of the gun, the rear end of the trigger bar 32 will engage the stop member 34, which in turn will activate the hammer 36 and in turn thereby activate the firing mechanism 14. As best seen in FIGS. 5 and 6, a notch 66 is formed in the back end of the trigger bar 32. When the trigger bar 32 is in the ready position, as best seen in FIG. 6, the upper surface 68 of the notch rests directly on the stop member 34, and the end surface 70 of the notch is thus directly aligned with the stop member 34 so as to be able to engage and push the stop member 34 rearwardly when the trigger 16 is shifted from its non-firing position to its firing position. Other arrangements for selectively preventing and allowing the trigger from engaging the hammer 36 and thus actuate the firing mechanism 14 in response to moving the safety actuator 60 are also possible.

The safety actuator 60 in this example is in the form of a grip safety that is engaged essentially automatically when a user operatively grasps the grip 30 in the palm of the hand with thumb and fingers wrapped around the grip, although other arrangements for the safety actuator 60 are also possible. In this example, the safety actuator 60 comprises a lever that extends from a pivot 72, such as a pin or hinge, downwardly from just underneath the firing mechanism 14 along an upper portion of the rear surface of the grip 30. A resilient member (not shown), such as a torsion spring, coil spring, or other suitable resilient member, may be provided to urge the safety actuator 60 away from the rear outer surface of the grip 30 in its disengaged position. Then, when a user grasps the grip 30, the palm will automatically engage and depress the safety actuator 60 toward the rear surface of the grip into its engaged position. In other arrangements, however, the safety actuator 60 need not necessarily be a pivoting member, but could simply shift linearly between the disengaged position and the engaged position. As a result, when the safety actuator 60 is in the disengaged position projecting away from the rear surface of the grip 30, the overall safety mechanism 20 is in the safety-on position that prevents firing of the air gun 10, and when the safety actuator 60 is in the engaged position pressed toward the rear surface of the grip 30, the overall safety mechanism 20 is in the safety-off position that allows firing of the air gun 10.

The finger 62 is operatively coupled to the safety actuator 60 so as to move in response to movement of the safety actuator 60 between its disengaged position and engaged position. In this example, the finger 62 is operatively coupled with the upper end of the lever of the safety actuator 60 so as to rotate about the pivot 72 in direct response to pivoting motion of the lever about the pivot 72. The finger 62 may be integral with and/or connected directly to the lever, or the finger 62 may be separate from the lever and otherwise caused to rotate about the pivot 72 in response to corresponding pivoting of the lever. In this example, each of the finger 62 and the lever of the safety actuator 60 are coupled to and rotate about the same axis defined by the pivot 72.

Figure 7:
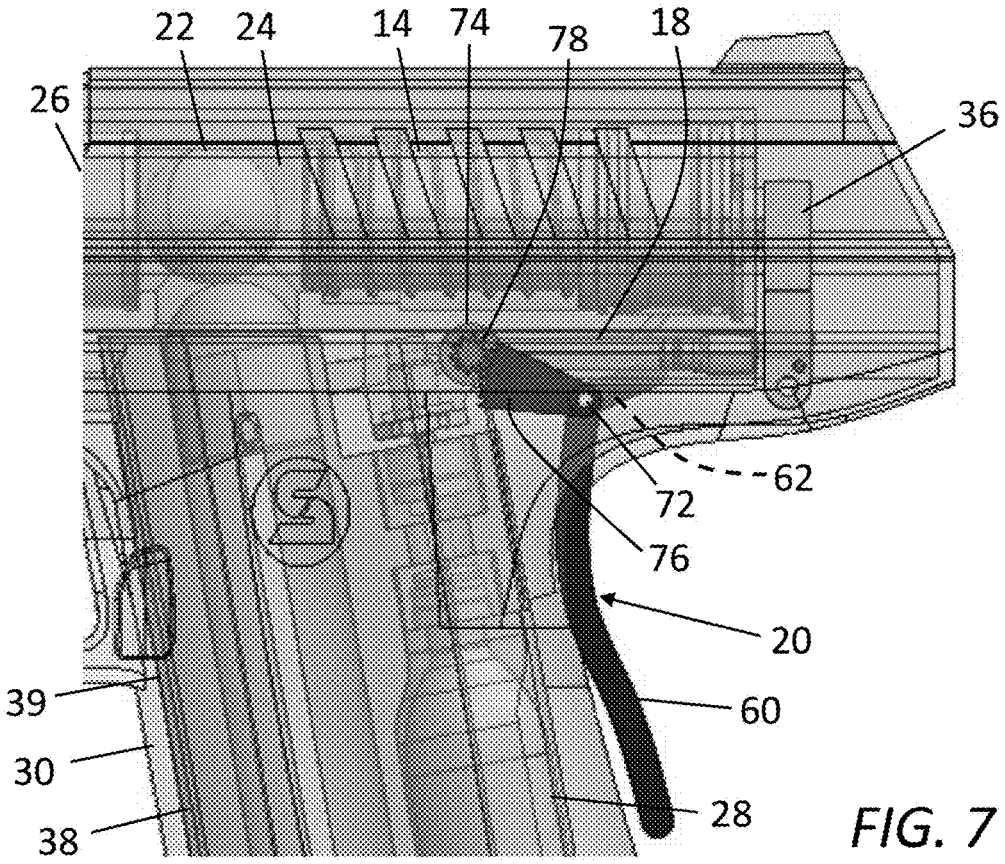
FIG. 7 is an enlarged left side view of the air gun of FIGS. 1 and 2 showing additional details of the safety mechanism in the safety-on position, wherein a valve of the safety mechanism is shown in a closed position to prevent a compressed gas from flowing from the gas canister to a firing chamber of the air gun.
Figure 8:
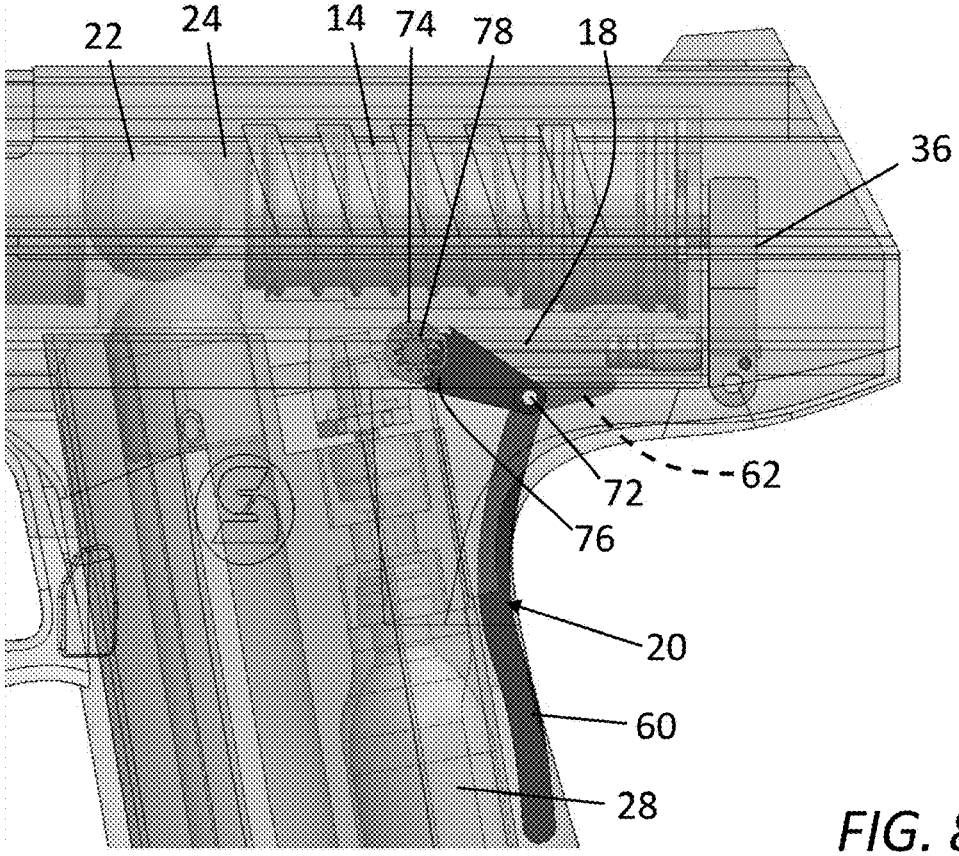
FIG. 8 is an enlarged left side view of the air gun of FIGS. 1 and 2 showing details of the safety mechanism in the safety-off position, wherein the valve of the safety mechanism is shown in an open position to enable the compressed gas to flow from the gas canister to the firing chamber of the air gun.
Figure 11:
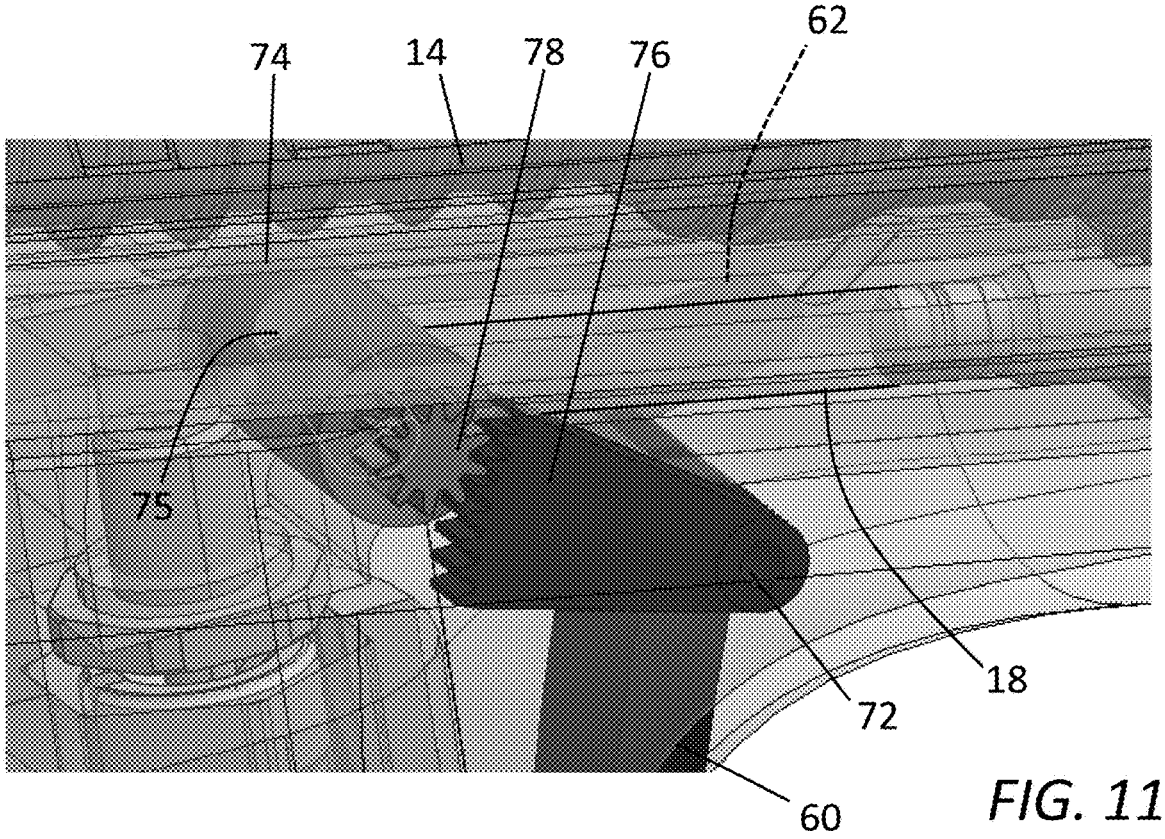
FIG. 11 is an enlarged left perspective view of the safety mechanism in the safety-on position and the passage of the valve of the safety mechanism in the closed position to prevent the compressed gas from flowing therethrough.
Figure 12:
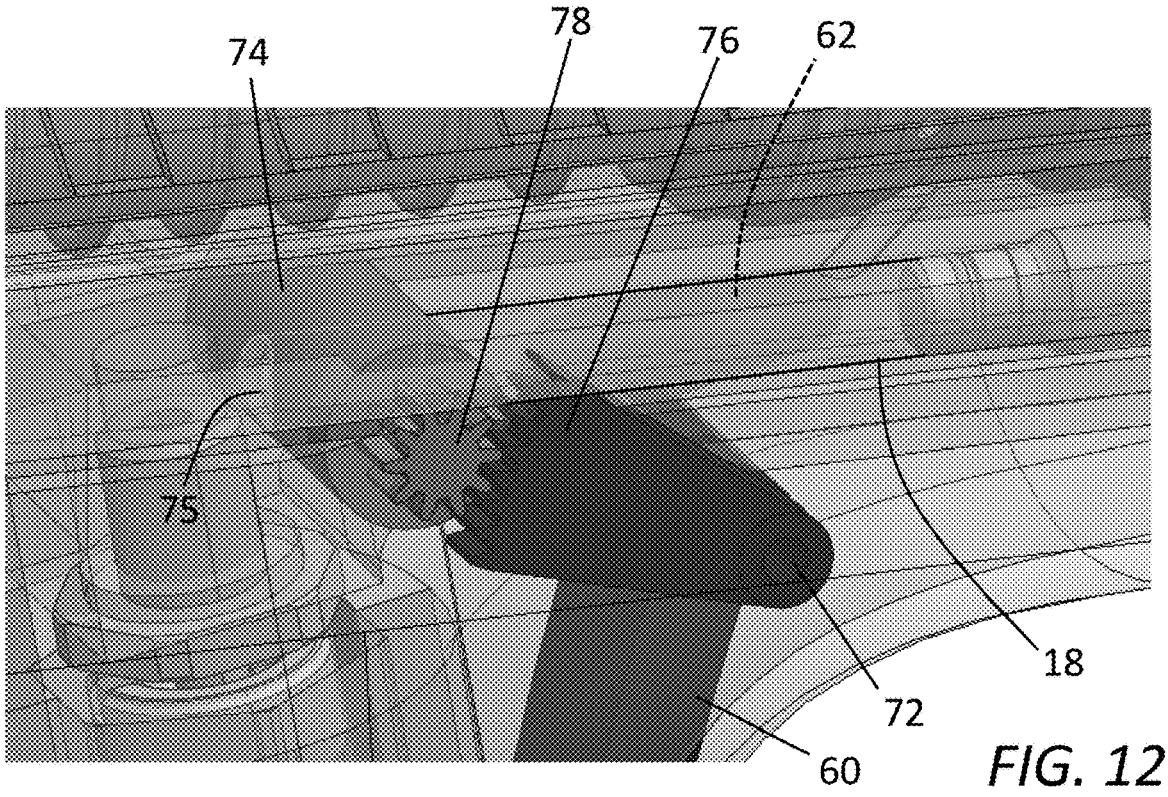
FIG. 12 is an enlarged left perspective view of the safety mechanism in the safety-off position and the passage of the valve of the safety mechanism in the open position to enable the compressed gas to flow therethrough.

As best seen in FIGS. 7-12, the second sub-mechanism of the safety mechanism 20 is a gas supply safety mechanism that includes a valve 74 that is operatively disposed along the gas supply duct 18 so as to selectively allow and/or prevent the flow of compressed gas into the firing mechanism 14 necessary for actuating the firing mechanism 14 and ultimately ejecting a projectile 22 along the barrel 26. In the nonlimiting example represented in the drawings, the valve 74 is a rotary valve operatively placed along the gas supply duct 18 so as to be able to selectively open and close the gas supply duct 18. In its closed position, the valve 74 is oriented to form a barrier between adjacent portions of the gas supply duct 18 to effectively close the gas supply duct 18. In the open position of the valve 74, a valve passage 75 within the valve 74 is oriented to provide fluidic continuity between the adjacent portions of the gas supply duct 18, effectively opening the gas supply duct 18 to allow compressed gas to flow therethrough. The valve 74 is operatively coupled with the safety actuator 60 such that when the safety actuator 60 is in its disengaged position, the valve 74 is in its closed position, as shown in FIGS. 7, 9, and 11, and when the safety actuator 60 is in its engaged position, the valve 74 is in its open position, as shown in FIGS. 8, 10, and 12. In the nonlimiting embodiment represented in the drawings, the valve 74 is rotated through the action of a first gear 76 operatively coupled with the safety actuator 60 that is engaged with a corresponding second gear 78 operatively coupled with the valve 74. When the safety actuator 60 is in its disengaged position, the first gear 76 rotates the second gear 78 causing the valve 74 to rotate to its closed position. When the safety actuator 60 is in its engaged position, the first gear 76 rotates the second gear 78 causing the valve 74 to rotate to its open position, thereby aligning the valve passage 75 with the adjacent portions of the gas supply duct 18 to provide fluidic continuity therethrough. In this example, the first gear 76 is a partial arc section of a spur gear connected directly to the upper end of the lever of the safety actuator 60 and/or to the pivot 72, and the second gear 78 is a pinion gear connected directly to or formed on the rotary valve 74. However, other gearing arrangements, such as a rack and pinion drive if the safety actuator 60 were to move linearly instead of pivotably, and other types of valves, such as a butterfly valve, piston valve, or other selectively actuatable valve, could be used.

In operation, the safety mechanism 20 functions to engage and/or disengage each of the two safety sub-mechanisms (the hammer safety mechanism and the gas supply safety mechanism as described above) in response to engagement and/or disengagement of the single safety actuator 60. Thus, in this example each of the lever of the safety actuator 60, the finger 62, and the first gear 76 are operatively fixedly connected with each other to move as a single unit that pivots about the single axis through the pivot 72. The lever, the finger 62, and the first gear 76 may be formed as a single unitary component, or may be otherwise operatively fixedly connected with each other, for example, by each being fixedly coupled to a pin that forms the pivot 72.

To operate the air gun 10, a user can easily remove the magazine 38 from the magazine receiver 39 inside the grip 30, for example by releasing the magazine 38 from the cavity within the grip 30 and sliding the magazine 38 downwardly and out of the bottom end of the grip 30. Once removed from the grip 30, the magazine 38 can be loaded with projectiles 22 in the projectile feeder 42, and the gas canister 28 with pressurized gas therein can be inserted into the cavity 44. The plunger mechanism 50 can be advanced upwardly, driving the top end of the gas canister 28 against the puncture needle 46 to sealingly couple with the push valve 48. Thus loaded, the magazine 38 can be inserted into the magazine receiver 39, for example, by sliding the top end of the magazine 38 upwardly into the magazine receiver 39 from the bottom end of the grip 30, until the magazine 38 locks into its operative position inside the grip 30. In this operative position, the nipple 56 of the gas supply coupling 54 is inserted into the socket 58 of the valve actuator 52 to form a sealed connection therebetween that fluidically couples the gas canister 28 with the gas supply duct 18. The nipple 56 simultaneously pushes down on the valve actuator 52, which opens the push valve 48 and allows compressed gas within the gas canister 28 to travel into the gas supply duct 18. At this point, however, the safety mechanism 20 is typically in its safety-on position and the valve 74 is in its corresponding closed position, which prevents the compressed gas from reaching the firing mechanism 14. Thereafter (or possibly simultaneously), a projectile 22 may be fed into the firing chamber 24 from the projectile feeder 42 by any appropriate feeding mechanism.

To fire the projectile 22, the user must first switch the safety mechanism 20 to its safety-off position by depressing the safety actuator 60, for example by grasping the grip 30 in the palm and wrapping the thumb and fingers around the grip 30 in the usual manner to cause the lever of the safety actuator 60 to rotate or otherwise move toward the grip 30, thereby shifting the safety actuator 60 from its disengaged position to its engaged position. This action simultaneously shifts the trigger bar 32 into its ready position and shifts the valve 74 to its open position. Thereafter, when a user squeezes the trigger 16, the trigger 16 is able to move from its non-firing position to a firing position, which shifts the trigger bar 32 rearwardly to activate the hammer 36, which in turn causes a charge of the compressed gas from the gas supply duct 18 to enter the firing mechanism 14 and forcibly eject the projectile 22 through and out of the forward end of the barrel 26. When the user releases the grip 30, the action of the safety mechanism 20 reverses, such that the safety actuator 60 returns to its disengaged position, which simultaneously shifts the trigger bar 32 back to its safe position and closes the valve 74.

Advantageously, if the user wishes to reload projectiles 22 into the magazine 38 before the compressed gas inside the gas canister 28 is completely discharged, the magazine 38 can be unlocked and removed from the magazine receiver 39, and the connection between the gas supply coupling 54 and the valve actuator 52 is broken, which results in the push valve 48 closing automatically and thereby retaining any unused compressed gas inside the gas canister 28 while the canister 28 remains within the magazine 38. After reloading projectiles 22 into the projectile feeder 42, the magazine 38 can be again locked into place in its operative position inside the grip 30, thereby reestablishing the connection between the gas supply coupling 54 and the valve actuator 52 to allow the remaining compressed gas inside the gas canister 28 to be used for further firing of the air gun 10.

As previously noted above, though the foregoing detailed description describes certain aspects of one or more particular embodiments of the invention, alternatives could be adopted by one skilled in the art. For example, the air gun and/or its components could differ in appearance and construction from the embodiments described herein and shown in the drawings, functions of certain components of the air gun could be performed by components of different construction but capable of a similar (though not necessarily equivalent) function, and various materials could be used in the fabrication of the air gun and/or its components. As such, and again as was previously noted, it should be understood that the invention is not necessarily limited to any particular embodiment described herein or illustrated in the drawings.

The invention claimed is:

1. An air gun comprising:

a firing mechanism for firing a projectile from the air gun by means of compressed gas;

a gas supply duct configured to direct a supply of compressed gas to the firing mechanism;

a trigger configured to actuate the firing mechanism when the trigger is shifted from a non-firing position to a firing position; and a safety mechanism having a safety-on position and a safety-off position;

wherein the safety mechanism in the safety-on position prevents the trigger from actuating the firing mechanism and closes the gas supply duct; and wherein the safety mechanism in the safety-off position enables the trigger to actuate the firing mechanism and opens the gas supply duct to enable actuating the firing mechanism with compressed gas to fire a projectile.

2. The air gun of claim 1 further comprising a valve disposed along the gas supply duct, wherein the valve has a closed position that closes the gas supply duct and an open position that opens the gas supply duct;

wherein the safety mechanism in the safety-on position urges the valve into the closed position; and wherein the safety mechanism in the safety-off position urges the valve into the open position.

3. The air gun of claim 2 further comprising a grip adjacent the trigger, wherein the safety mechanism comprises a safety actuator disposed along the grip, the safety actuator shifts relative to the grip between an engaged position and a disengaged position, the safety actuator is in the disengaged position when the safety mechanism is in the safety-off position, and the safety actuator is in the engaged position when the safety mechanism is in the safety-on position.

4. The air gun of claim 3, wherein the safety actuator comprises a first gear, and the valve comprises a second gear engaged with the first gear, wherein first gear rotates the second gear when the safety actuator moves between the disengaged position and the engaged position to shift the valve between the closed position and the open position.

5. The air gun of claim 4, wherein the valve comprises a rotary valve coupled to the second gear.

6. The air gun of claim 4, further comprising:

a hammer that actuates the firing mechanism; and a trigger bar that engages the hammer when the trigger is shifted from the non-firing position to the firing position to actuate the firing mechanism;

wherein the safety actuator in the disengaged position shifts the trigger bar to a safe position that is out of alignment with the hammer so as to prevent the trigger bar from engaging the hammer; and wherein the safety actuator in the engaged position shifts the trigger bar to a ready position that is in alignment with the hammer so as to allow the trigger bar to engage the hammer.

7. The air gun of claim 6, wherein the safety actuator comprises a lever that pivots between the engaged position and the disengaged position.

8. The air gun of claim 7, wherein the safety actuator includes a finger that engages the trigger bar, the finger pivots to shift the trigger bar out of alignment with the hammer when the lever is pivoted to the disengaged position, and the finger pivots to shift the trigger bar into alignment with the hammer when the lever is pivoted to the engaged position.

9. The air gun of claim 8, wherein the trigger bar pivots between the safe position and the ready position.

10. The air gun of claim 8, wherein each of the lever, the first gear, and the finger pivot about a single axis.

11. The air gun of claim 10, wherein the lever extends along the grip from the axis, wherein in the disengaged position, the lever is urged away from the grip, and in the engaged position, the lever is urged toward the grip.

12. The air gun of claim 11, further comprising a resilient member that urges the lever away from the grip.

13. The air gun of claim 1, further comprising:

a frame carrying the firing mechanism, the trigger, the safety mechanism, and the gas supply duct;

a gas supply coupling carried by the frame; and a removable magazine that locks into the grip;

wherein the gas supply coupling is configured to operatively couple a gas canister carried in the removable magazine with the gas supply duct when the removable magazine is locked into the grip; and wherein the gas supply coupling is configured to operatively uncouple the gas canister from the gas supply duct when the removable magazine is removed from the grip.

14. The air gun of claim 13, the removable magazine further comprising a push valve that operatively engages the gas canister to selectively release compressed gas from the gas canister;

wherein the gas supply coupling operatively couples with the push valve when the removable magazine is locked into the grip to allow passage of gas from the gas canister to the gas supply duct; and wherein the gas supply coupling operatively disengages from the push valve when the removable magazine is removed from the grip.

15. The air gun of claim 14, wherein the gas supply coupling opens the push valve when the removable magazine is locked into the grip, and wherein the push valve closes when the gas supply coupling is operatively disengaged from the push valve.

16. A method of using the air gun of claim 1, the method comprising switching the safety mechanism to the safety-off position by simultaneously enabling the trigger to actuate the firing mechanism and opening the gas supply duct.

17. The method of claim 16, further comprising switching the safety mechanism to the safety-on position by simultaneously preventing the trigger from actuating the firing mechanism and closing the gas supply duct.

18. A removable magazine for an air gun, the removable magazine comprising:

a magazine body;

a projectile feeder carried in the magazine body;

a cavity defined inside the magazine body for receiving a gas canister therein;

a push valve carried by the magazine body for selectively releasing pressurized gas from a gas canister disposed in the cavity; and a valve actuator carried by the push valve;

wherein the valve actuator is accessible from outside of the magazine body through an opening in the magazine body, and the valve actuator comprises a socket configured to releasably receive therein a nipple of a gas supply coupling carried by an air gun and form a seal with the nipple and to open the push valve when operatively coupled with the gas supply coupling.

19. The removable magazine of claim 18, wherein the push valve closes when not engaged by the gas supply coupling.

* * * * *